United States Patent [19]

Hasty

[11] 4,099,350

[45] Jul. 11, 1978

[54] HONING ASSEMBLY

[75] Inventor: Jerry N. Hasty, Plymouth, Mich.

[73] Assignee: MWA Company, Owosso, Mich.

[21] Appl. No.: 802,266

[22] Filed: May 31, 1977

[51] Int. Cl.[2] ..... B24B 33/08

[52] U.S. Cl. ..... 51/338; 51/345; 51/346

[58] Field of Search ..... 51/338, 339, 340, 342, 51/343, 344, 345, 346, 355

[56] References Cited

U.S. PATENT DOCUMENTS

| | | | |
|---|---|---|---|
| 1,828,074 | 10/1931 | Roebbel | 51/340 |
| 2,302,207 | 11/1942 | Gjertsen | 51/339 |
| 2,349,994 | 5/1944 | Snader | 51/338 |
| 2,350,969 | 6/1944 | Sunnen | 51/338 X |
| 2,828,540 | 4/1958 | Harrah | 30/85 X |
| 3,403,481 | 10/1968 | McDonald | 51/338 X |

*Primary Examiner*—N. P. Godici

[57] ABSTRACT

A honing assembly comprising a hollow head or shell provided with a plurality of circumferentially spaced slots, honing elements projecting from said slots, and an adjusting member longitudinally adjustably supported within the head. The adjusting member has longitudinally tapered surfaces provided with elongated undercut grooves. The honing elements have studs shaped to fit the grooves so that longitudinal movement of the adjusting member will cause radially inward or outward movement of the honing elements depending on the direction of movement of the adjusting member.

2 Claims, 8 Drawing Figures

HONING ASSEMBLY

BACKGROUND AND SUMMARY OF THE INVENTION

This invention relates generally to a honing tool and refers more particularly to a honing tool having improved means for adjusting the honing elements radially inwardly and outwardly.

In prior constructions, the honing elements have been held in the slots by means of a tight fit. However, a tight fitting honing element will eventually enlarge the slot and become loose. At that point, it becomes necessary to replace the head. Then, too, a tight fitting honing element is difficult to install without damaging it. A further disadvantage inherent in this prior construction is that it affords no means of retracting the honing elements.

In accordance with the present invention, the adjusting member is formed with longitudinally extending undercut grooves. The honing elements are provided with studs having a complementary shape to fit the grooves. Accordingly, longitudinal movement of the adjusting member will cause radially inward or outward movement of the honing elements depending upon the direction in which the adjusting member is moved. Because the grooves are undercut and the studs on the honing element have a complementary shape, the honing elements can be moved radially inwardly as well as outwardly by the movement of the adjusting member.

Other objects and features of this invention will become more apparent as the description proceeds, especially when taken in conjunction with the accompanying drawings, wherein.

Figure 1:
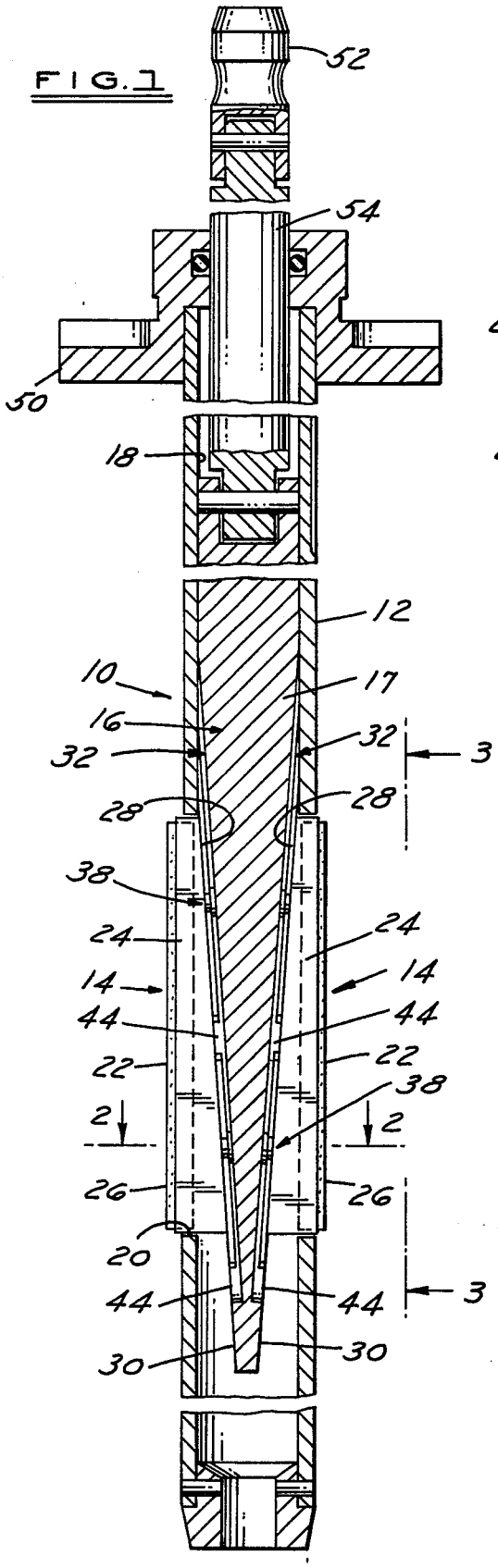
FIG. 1 is a longitudinal sectional view of a honing assembly constructed in accordance with my invention.
Figure 2:
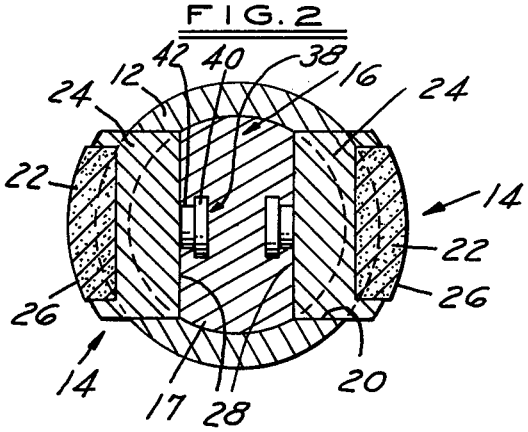
FIG. 2 is a sectional view taken on the line 2—2 in FIG. 1.
Figure 3:
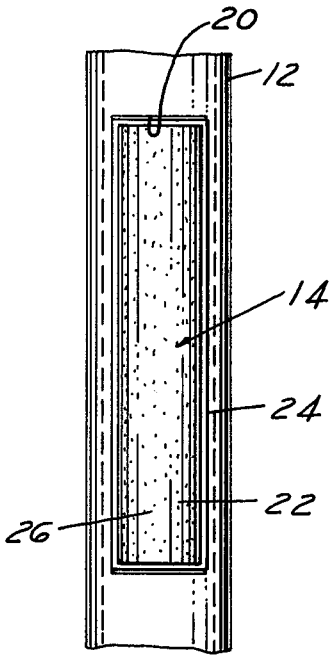
FIG. 3 is a fragmentary elevational view as seen from the side of the honing assembly on the line 3—3 in FIG. 1.
Figure 8:
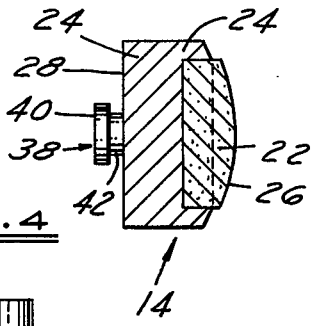
FIG. 8 is a sectional view taken on the line 8—8 in FIG. 6.

Referring now more particularly to the drawings, the honing assembly or tool is generally designated 10 and comprises an elongated tubular head or shell 12, a plurality of honing elements 14 and an adjusting member 16.

The head 12 has a smooth cylindrical inner surface 18 within which the cone 17 of the adjusting member 16 is axially slidably supported. In its lower end portion, the head 12 has a plurality of elongated circumferentially spaced rectangular slots 20 which are shown as extending axially of the head. In accordance with the specific embodiment illustrated in the drawings, only two such slots 20 are shown, being spaced 180° apart or diametrically opposite one another, but it will be understood that only one or more than two circumferentially spaced slots 20 may be provided if desired. A honing element 14 projects through each slot 20.

Figure 6:
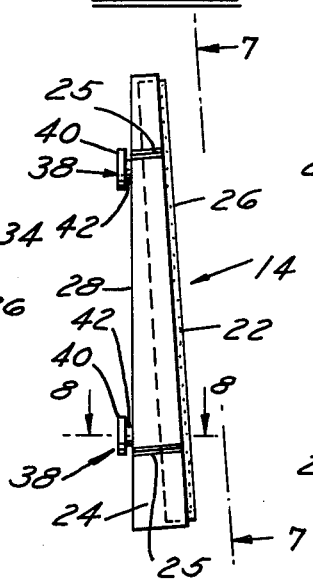
FIG. 6 is an elevational view of one of the honing elements.
Figure 7:
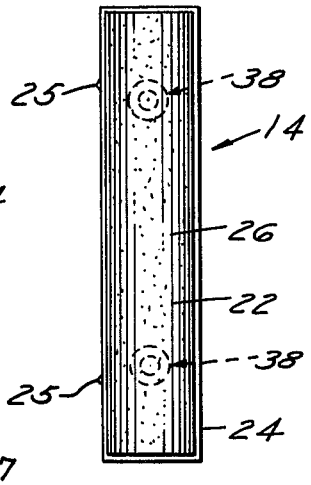
FIG. 7 is a front view of the honing element as seen on the line 7—7 in FIG. 6.

The honing elements may be of any suitable construction and in the present instance each comprises an elongated abrasive element or stone 22 mounted in a rectangular holder 24. The holders 24 may be of any suitable material such, for example, as metal or plastic and are dimensioned to have a close fit in the slots 20. The front working face 26 of the stone 22 is exposed. Both sides and both ends of the stone as well as its rear face are shown as being covered by the plastic material of the holder. The rear face or base 28 of the holder 24 is inclined longitudinally of the honing element as indicated in FIGS. 1 and 6.

If desired, the holders may have shearable ribs 25 on one side to take up clearance. These ribs shear off when the honing elements are inserted in the slots. Such ribs may be integral parts of a plastic holder, or may be adhered to the holder. They may be formed of suitable shearable material such, for example, as paste-like synthetic resins, silicones or butanes. The ribs are not essential to the practice of the invention.

The adjusting member 16 has an elongated cone 17 which is cylindrical at the top and tapered at the lower end by having two longitudinally inclined flat surface portions 30 on diametrically opposite sides thereof. These flat surface portions 30 are inclined at the same angle as the base 28 of each honing element, and each is disposed in substantially full surface-to-surface contact with the base 28 of a honing element as seen in FIG. 1.

Figure 5:
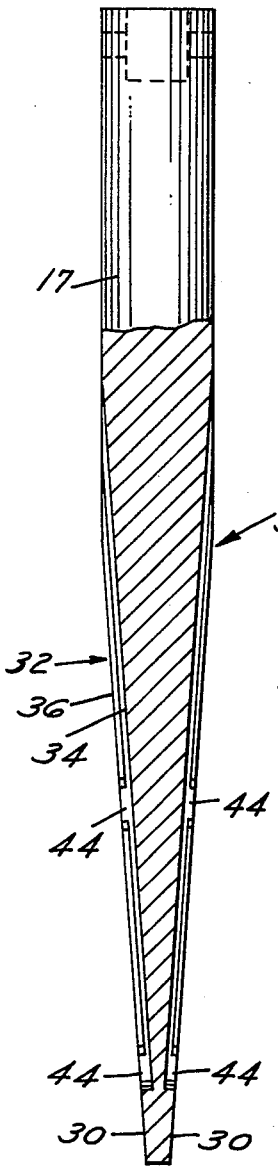
FIG. 5 is a view partly in elevation and partly in section of the adjusting cone taken on the line 5—5 in FIG. 4.
Figure 4:
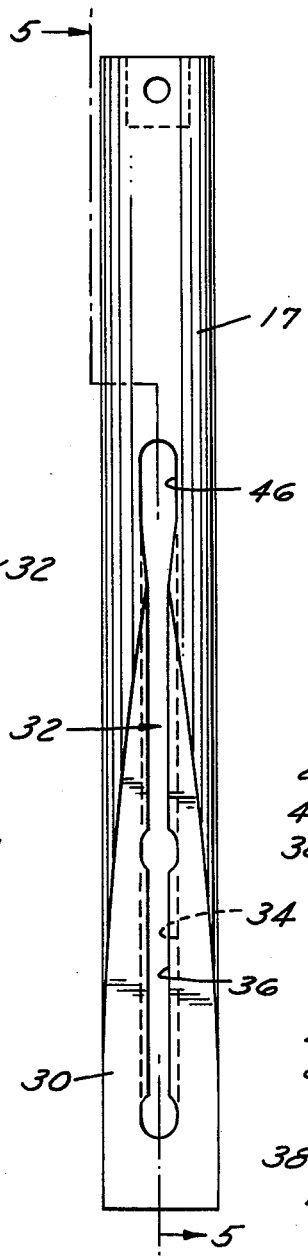
FIG. 4 is a elevational view of the adjusting cone.

An elongated groove 32 is formed in each tapered surface portion 30. These grooves are of uniform depth throughout substantially their full length and thus are inclined to the longitudinal axis of the cone 17 at the same angle as the surface portions 30. Such grooves are undercut so that they are wider at the bottom than at the top and preferably the undercutting is such as to produce a T-shaped cross section. Each groove thus has a relatively wide portion 34 at the bottom and a relatively narrow portion 36 at the top. As seen in FIGS. 4 and 5, the upper end of each groove extends beyond the tapered surface portion 30 and becomes shallower and shallower until it gradually disappears.

Each honing element has on the rear side or base 28 of the holder a pair of longitudinally spaced studs 38. Each stud has a circular disc-like head portion 40 connected to the base by a circular neck portion 42 of reduced diameter. The head portion 42 of each stud has a width or diameter equal to or slightly less than the width of the relatively wide portion 34 of the groove, but greater than the relatively narrow portion 36. The neck portion 42 is of the same width, or slightly less, than the width of the relatively narrow portion 36 of the groove. Accordingly, the studs have substantially the same T-shaped cross section as the grooves, and when assembled in the grooves the head portions 40 of the studs lightly contact the bottoms of the grooves as well as the lips which form the narrow groove portions 36. The studs will slide longitudinally to effect adjustment of the honing elements, but are retained against pulling out by the undercut groove configuration. The engagement of the studs in the grooves holds the rear surfaces 28 of the honing elements in full surface-to-surface sliding contact with the surface portions 30 of cone 17.

Each groove in the cone 17 has a pair of longitudinally spaced openings 44 which are spaced apart the same distance as the studs 38. These openings 44 are formed in narrow portions 36 of the grooves and are of the same width as the wide portions 34 thereof. Hence the studs may be assembled simultaneously into the grooves through these openings. The upper tapered end of each groove also has an opening 46 which is of the same width as the openings 42.

The head 12 has a driving part 50 at the upper end by means of which it may be rotated and reciprocated. The adjusting member includes a driving part 52 by means of which the cone 17 may be adjusted up and down in the head. The driving part 52 is connected to the cone by a rod 54.

FIG. 1 shows the honing tool with its parts assembled and with the honing elements in operative position. In this position, the studs 38 on the honing elements are spaced a substantial distance from the openings 44 and 46 so that they will not accidentally become separated from the tool. Th cone 17 may be raised sufficiently however to bring the openings 44 into alignment with the studs so that the honing elements may be removed and replaced. In this raised position of the cone, however, the honing elements are retracted inwardly beyond the point where honing would normally be carried out. The rear face 28 of each honing element is disposed in substantially full surface-to-surface contact with the tapered surface portion 30 on which it is mounted so that it will be cammed outwardly when the cone is moved downwardly. Inward adjustment of the honing elements is accomplished by the studs during upward movement of the cone.

What I claim as my invention is:

1. A honing assembly comprising an elongated hollow head provided with a plurality of circumferentially spaced slots, honing elements projecting from said slots, an elongated adjusting member for said honing elements longitudinally adjustably supported within said head, said adjusting member having elongated longitudinally tapered surface portions registering with said respective slots, longitudinally extending, continuous undercut grooves in said tapered surface portions of said adjusting member, and a pair of longitudinally spaced studs on each honing element, said studs being shaped to fit slidably in said undercut grooves so that longitudinal movement of said adjusting member relative to said head in one direction will cause radially inward movement of said honing elements, the radially inner surfaces of said honing elements engaging said tapered surface portions of said adjusting member to cause said honing elements to be cammed radially outwardly when said adjusting member is moved longitudinally in the opposite direction, each groove having a pair of openings spaced apart longitudinally the same distance as each pair of studs to permit said studs to enter said grooves and to be withdrawn therefrom, whereby said honing elements can be assembled and disassembled with respect to said adjusting member, said groove openings being located longitudinally in positions such that they will register with said studs only when the honing elements are retracted inwardly beyond a point where honing would normally be carried out.

2. A honing assembly as defined in claim 1, wherein said grooves are generally T-shaped in cross section being relatively wide at the bottom and relatively narrow at the top, said studs also being generally T-shaped in cross section having a head portion dimensioned to fit in the relatively wide portion of said grooves and a neck portion dimensioned to fit in the relatively narrow portion thereof.

* * * * *